US007249824B2

(12) United States Patent
Ogawa et al.

(10) Patent No.: US 7,249,824 B2
(45) Date of Patent: Jul. 31, 2007

(54) LIQUID DISCHARGE HEAD HAVING INDUCTIVE CHANNEL AND RECORDING DEVICE INCORPORATING LIQUID DISCHARGE HEAD

(75) Inventors: Masashi Ogawa, Tokyo (JP); Wataru Takahashi, Tokyo (JP); Hiromasa Amma, Tokyo (JP); Yasuo Kotaki, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 337 days.

(21) Appl. No.: 11/012,459

(22) Filed: Dec. 14, 2004

(65) Prior Publication Data

US 2005/0140750 A1 Jun. 30, 2005

(30) Foreign Application Priority Data

Dec. 26, 2003 (JP) ..... 2003-434952

(51) Int. Cl.
*B41J 2/05* (2006.01)

(52) U.S. Cl. ..... 347/65; 347/92

(58) Field of Classification Search ..... 347/84–87, 347/92–94, 20, 56
See application file for complete search history.

(56) References Cited

U.S. PATENT DOCUMENTS 5,812,165 A 9/1998 Boyd ..... 347/87
6,513,920 B1 * 2/2003 Deshmukh et al. ..... 347/92

* cited by examiner

*Primary Examiner*—Juanita D. Stephens
(74) *Attorney, Agent, or Firm*—Canon U.S.A. Inc I.P. Div

(57) ABSTRACT

An ink print head reducing ink supply errors caused by air bubbles in order to stably supply ink at larger amounts. The ink print head includes an ink container for holding ink, a recording element for discharging the ink supplied from the ink container, a duct disposed between the ink container and the recording element to transfer the ink to the recording element, and an inductive channel which communicates with the duct. The inductive channel transfers the ink to the recording element from the ink container, and has a capillary force greater than that of the duct.

15 Claims, 11 Drawing Sheets

LIQUID DISCHARGE HEAD HAVING INDUCTIVE CHANNEL AND RECORDING DEVICE INCORPORATING LIQUID DISCHARGE HEAD

BACKGROUND OF THE INVENTION

1. Field of the Invention

The present invention relates to a liquid discharge head for discharging liquid, such as ink, towards a recording medium. The present invention also relates to a recording device for recording, for example, an image onto a recording medium, such as a sheet material.

2. Description of the Related Art

A typical inkjet print head generally includes an ink container for holding ink; an exothermic element, i.e. a recording element, for discharging ink; and a duct for transferring ink to the exothermic element from the ink container.

Such a typical inkjet print head has a tendency to accumulate many air bubbles. These air bubbles are accumulated in the inkjet print head in several ways. For example, such an accumulation may be due to air entering the duct as a possible result of a change in the environment, or may be due to air bubbles remaining in the ink. Moreover, there are also cases where the air bubbles are generated due to exothermic heat or are formed in the process of fabrication of the inkjet print head. It is generally known that air bubbles inside the duct interfere with the flow of the ink being transferred to the exothermic element.

Air bubbles present on the main surface of the exothermic element can interfere with the formation of desired air bubbles, and moreover, an absorption effect generated by the undesired air bubbles reduces the pressure required for discharging the ink. This means that the ink cannot be discharged properly, thus leading to recording defects. Furthermore, if the air bubbles remain in the interior of an ink-supplying system, the ink cannot be sufficiently supplied to the exothermic element.

U.S. Pat. No. 5,812,165, for example, discloses a technique in which a groove is disposed inside a duct in order to prevent the ink supply from being interfered by air bubbles.

Furthermore, to reduce the air bubbles present in the interior of an ink-supplying system, the air bubbles, for example, may be removed by degassing the dissolved gas in the ink or may be prevented by providing a gas-liquid separation film in the ink-supplying system.

Moreover, to physically remove the air bubbles, the air bubbles, for example, may be removed by vacuuming the ink through ink discharge nozzles or by changing the components of the ink so as to allow easier defoaming of the air bubbles.

Removing the air bubbles by degassing the dissolved gas in the ink complicates the fabrication process of the inkjet print head. Moreover, according to this degassing technique, it is necessary to maintain a state where the air does not penetrate into the ink-supplying system during the actual use of the inkjet print head. This results in a complex structure of an ink cartridge. Moreover, this degassing technique is also problematic in that the air may enter through the ink discharge nozzles or through gaps between the components of the ink cartridge as time passes, meaning that maintaining the degassed state of the ink is extremely difficult.

On the other hand, providing the gas-liquid separation film requires a space in the ink-supplying system where the gas-liquid separation film is to be disposed. Moreover, an additional gas-liquid separation film must be disposed on the ink discharge nozzles in order to prevent air bubbles from entering through the nozzles.

Furthermore, removing the air bubbles by vacuuming the ink through the ink discharge nozzles is also problematic. In detail, although this technique can be effectively achieved by, for example, making the shape of a duct such that the duct is easily removable, since both the air bubbles and the ink are vacuumed at the same time, the vacuumed ink becomes a waste. Moreover, since the printer must be additionally provided with a holding component for holding the vacuumed ink and a vacuuming mechanism, the manufacture cost of the printer increases. Furthermore, depending on the structure of the vacuuming mechanism, there are cases where it is necessary to vacuum ink that contains no air bubbles. This may reduce the amount of ink that can actually be used and thus may lead to higher manufacturing costs.

According to U.S. Pat. No. 5,812,165 in which the duct is provided with a groove and has corners and edges, the capillary forces generated in the groove, the corners, and the edges may be significantly different from one another depending on how the inkjet print head is positioned during the printing process. For this reason, there are cases where the continuity of the ink-supplying path is lost.

Furthermore, if the amount of ink Q2 retained by the capillary forces of the edges and the corners become greater than the amount of ink Q1 transferred via the groove, the ink in the groove is drawn towards the corners. This may result in shortage of ink in the groove. Accordingly, the equation Q1>Q2 must constantly be satisfied. Moreover, since inkjet print heads developed in recent years move at an extremely high speed, a larger amount of ink is required per unit time, meaning that a larger amount of ink must be supplied to the inkjet print head. Accordingly, the amount of ink Q2 must also be larger.

However, retaining a larger amount of ink with the capillary forces of the edges and the corners can induce an adverse effect upon the ink-supplying path if the gas is present inside the duct. To solve this problem, more edges and corners are required. This, however, results in a complex structure of the ink container. It is therefore in great demand that a larger amount of ink be supplied stably with a simple structure.

Furthermore, depending on the tilt angle of the inkjet print head, there are cases where it is difficult to retain a sufficient amount of ink with the capillary forces generated in the edges.

SUMMARY OF THE INVENTION

The present invention is directed to a liquid discharge head and a recording device that prevent defective supply of liquid caused by air bubbles so as to achieve a stable supply of a larger amount of liquid. In one aspect of the present invention, a liquid discharge head is provided with a liquid container adapted to hold liquid; a recording element; a duct which is disposed between the liquid container and the recording element and facilitates transferring of the liquid to the recording element; and an inductive channel communicating with the duct. The inductive channel transfers the liquid from the liquid container to the recording element, and moreover, is configured to generate a capillary force greater than that of the duct. The recording element is configured to discharge the liquid transferred from the liquid container.

As described above, according to the present invention, the inductive channel communicates with the duct and transfers the liquid from the liquid container to the recording element. Since the capillary force of the inductive channel is greater than that of the duct, even if the duct is filled with gas, at least the inductive channel can stably transfer the liquid from the liquid container to the recording element.

In one embodiment, the inductive channel is configured such that an amount of liquid supplied to the recording element per unit time by the inductive channel can be greater than an amount of liquid discharged per unit time by the recording element. Accordingly, even if the duct is filled with gas, a shortage of liquid is prevented so as to allow proper discharge of the liquid. Thus, the recording process, for example, can be properly performed.

Further features and advantages of the present invention will become apparent from the following description of the exemplary embodiments (with reference to the attached drawings).

DESCRIPTION OF THE EMBODIMENTS

Exemplary embodiments of the present invention will now be described in detail with reference to the drawings.

Figure 1A:
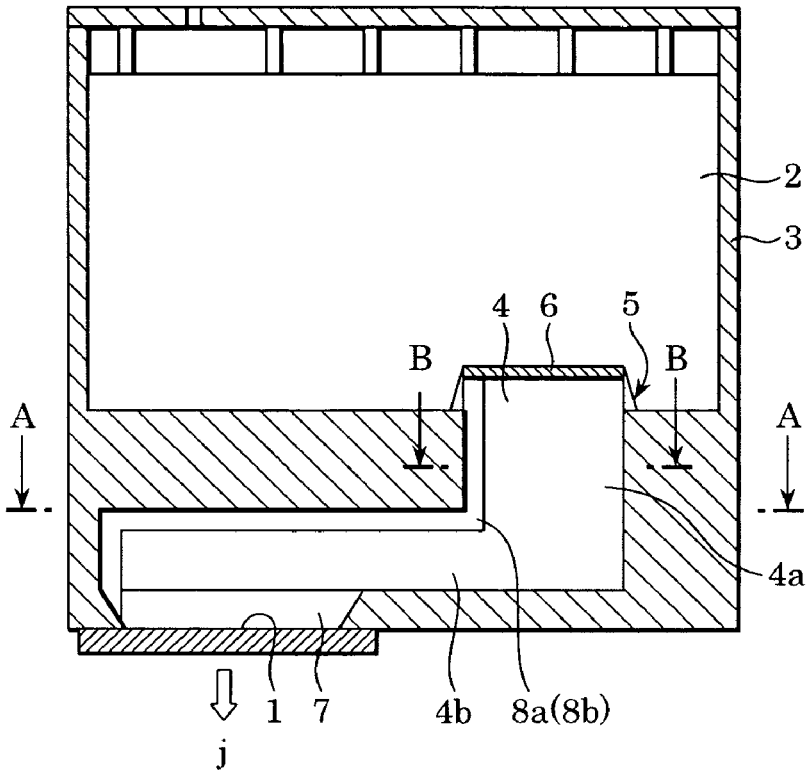
FIG. 1A is a schematic vertical sectional view of an inkjet print head according to an embodiment of the present invention.
Figure 1B:
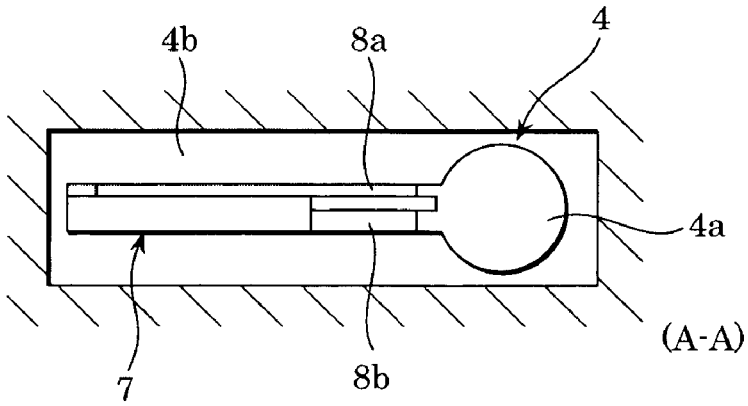
FIG. 1B is a horizontal cross-sectional view of a duct taken along line A-A in FIG. 1A.

FIG. 1A is a vertical sectional view of an inkjet print head according to an embodiment of the present invention, and FIG. 1B is a horizontal cross-sectional view of the inkjet print head taken along line A-A in FIG. 1A.

Referring to FIGS. 1A and 1B, the inkjet print head includes an exothermic circuit 1 having an exothermic element, which is not shown in the drawings. The exothermic element functions as a recording element for discharging ink towards a recording medium, such as recording paper, so as to record data on the recording medium. The inkjet print head further includes an ink absorber 2 for holding ink, and an ink container 3 for housing the ink absorber 2. The inkjet print head is provided with a duct 4 via which the ink absorber 2 and the exothermic circuit 1 communicate with each other. The duct 4 includes a cylindrical vertical portion 4*a* extending in the vertical direction and a rectangular horizontal portion 4*b* extending in the horizontal direction and connecting with the downstream side of the vertical portion 4*a*. Accordingly, the flow of the ink changes direction in the midsection of the duct 4.

Figure 2A:
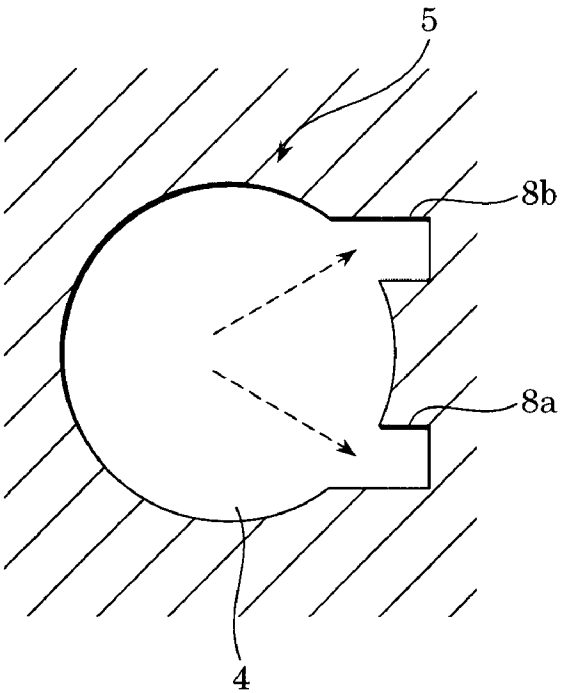
FIGS. 2A to 2C are horizontal cross-sectional views illustrating an example of a shape of a projection of the duct.

Referring to FIGS. 1A and 2A, the bottom inner surface of the ink container 3 is provided with a substantially cylindrical projection 5 which continuously extends from the duct 4 and connects the duct 4 and the ink absorber 2 together. FIG. 2A is a horizontal cross-sectional view taken along line B-B in FIG. 1A. The projection 5 extends into the ink absorber 2 so as to apply a compressive force to the ink absorber 2. This forces the ink inside the ink absorber 2 to be drawn towards the projection 5.

Figure 2B:
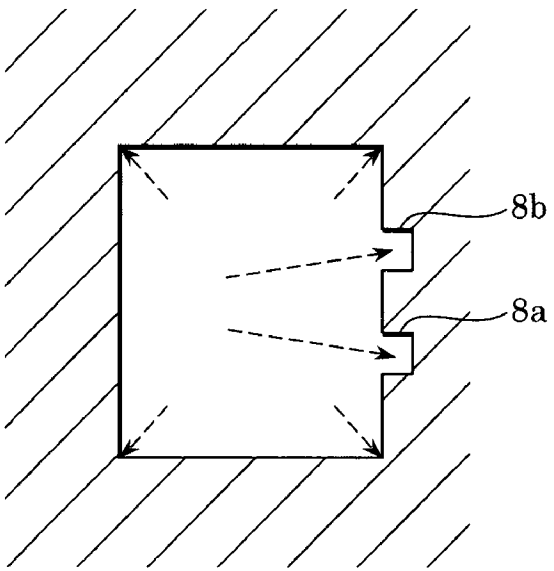
Figure 2C:
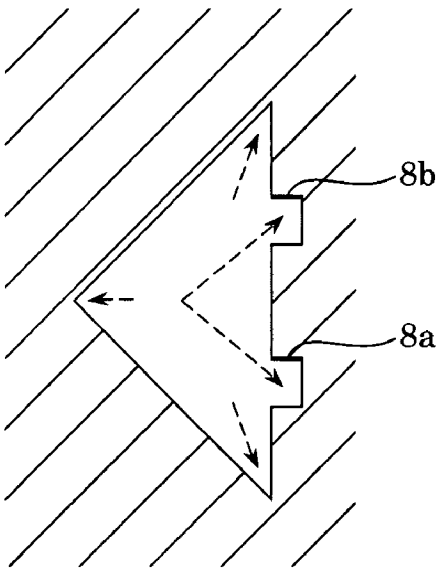

FIGS. 2A to 2C are horizontal cross-sectional views of the projection 5. Although the projection 5 is substantially cylindrical in this embodiment, the projection 5 may have other alternative tubular shapes that can transfer ink, such as a substantially rectangular shape or triangular shape in cross-section as respectively shown in FIGS. 2B and 2C.

Furthermore, a filter 6 for filtering impurities in the ink is disposed between the projection 5 and the ink absorber 2. The filter 6 not only prevents impurities from entering the duct 4 but also retains the ink drawn to the projection 5 with the meniscus force of the filter 6.

The inkjet print head further includes an ink-supplying hole 7 disposed on a side of the exothermic circuit 1 opposing the side from which ink is discharged in a direction indicated by an arrow j. The ink-supplying hole 7 continuously extends from the duct 4. The duct 4 includes a plurality of inductive channels 8*a* and 8*b*, each having a greater capillary force than the duct 4. The inductive channels 8*a* and 8*b* extend from the side surface of the projection 5 to the ink-supplying hole 7 above the exothermic circuit 1 while communicating with the duct 4. As shown in FIGS. 2A to 2C with dotted lines, the ink inside the duct 4 is drawn towards the inductive channels 8*a* and 8*b* each having a greater capillary force than the duct 4. In a case where the projection 5 is rectangular or triangular in cross-section, the ink inside the duct 4 is also drawn toward the edges of the duct 4, that is, toward the corners of the duct 4 in a cross-sectional view, due to the capillary force generated along the edges. Furthermore, each of the inductive channels 8*a* and 8*b* extends along the duct 4 such that the flow of ink changes midstream. Moreover, the inductive channel 8*a* is formed such that the direction of flow changes twice in its two midsections.

Figure 3:
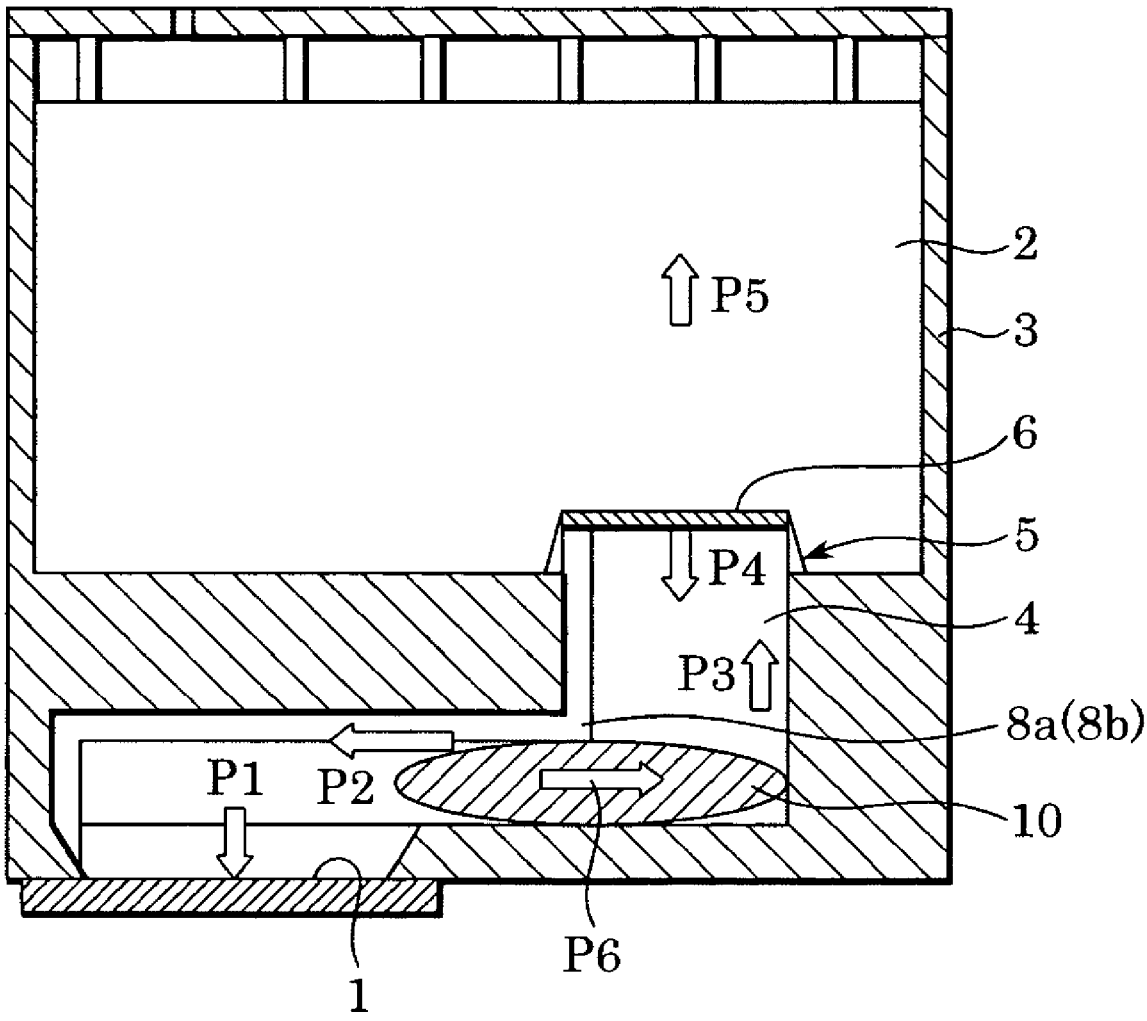
FIG. 3 is a vertical sectional view of the inkjet print head illustrating the ink-supplying operation in a state in which gas is present inside the duct.

The capillary force of each of the inductive channels 8*a* and 8*b* can be set in the following manner. FIG. 3 is a schematic vertical sectional view illustrating a state where gas 10 is present inside the duct 4 in the inkjet print head.

Referring to FIG. 3, a pressure generated by the exothermic circuit 1 is indicated by P1, a total capillary force generated in the inductive channels 8*a* and 8*b* is indicated by P2, a pressure generated in the corners and edges of the duct 4 is indicated by P3, a pressure generated when the ink passes through the filter 6 is indicated by P4, a negative pressure of the ink absorber 2 is indicated by P5, and a pressure of gas 10 inside the duct 4 is indicated by P6. The capillary force is set so as to satisfy the equation P2>P3. Accordingly, the total capillary force of the inductive channels 8*a* and 8*b* is greater than the capillary force of the duct 4.

Consequently, the ink drawn into the inductive channels 8*a* and 8*b* is transferred to the ink-supplying hole 7 by the capillary forces of the inductive channels 8*a* and 8*b* before the duct 4 is completely filled with ink. This fills up the ink-supplying hole 7, and thus forms an ink-supplying path extending continuously from the ink absorber 2 to the exothermic circuit 1. Accordingly, even if the duct 4 is filled with the gas 10, the inductive channels 8*a* and 8*b* are still capable of retaining ink.

In such a case where the duct 4 is filled with gas, in order to perform the ink supply operation only with the inductive channels 8*a* and 8*b*, the equation P1+P2+P4+P6>P5 must be satisfied. In this case, P3≈0.

The shape of the inductive channels 8*a* and 8*b* can be determined in view of the amount of ink used, the properties of the ink, the molding process, and the productivity, such that the ink can be supplied to the exothermic element only with the inductive channels 8*a* and 8*b* without underrunning the amount of ink discharged per unit time. Each of the inductive channels 8*a* and 8*b* according to this embodiment is a groove whose cross-sectional area taken along a plane perpendicular to the direction of flow is smaller than that of the duct 4. In detail, the groove is rectangular and has a cross-sectional area of about 0.5 mm×0.5 mm. Accordingly, this forms the ink-supplying path extending continuously from the ink container 3 to the ink-supplying hole 7.

With reference to FIGS. 4A to 4H, the process by which ink fills the duct 4 and the inductive channels 8*a* and 8*b* according to the inkjet print head of this embodiment will be described. FIGS. 4A to 4H are vertical sectional views each illustrating a state in which ink is being filled in the duct 4 and the inductive channels 8*a* and 8*b*.

Figure 4A:
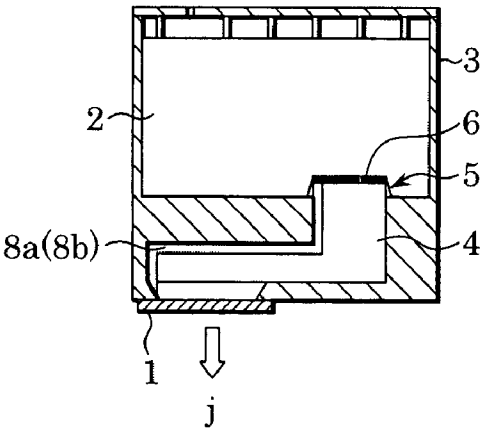
FIGS. 4A to 4H are vertical sectional views illustrating a state in which ink is being filled in the duct and inductive channels.
Figure 4B:
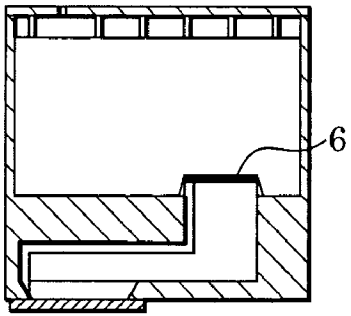

Referring to FIG. 4A, the ink is vacuumed in the direction of the arrow j, which is the ink-discharging direction. Subsequently, referring to FIG. 4B, this vacuum pressure draws the ink in the ink absorber 2 towards the filter 6 where the ink is filtered.

Figure 4C:
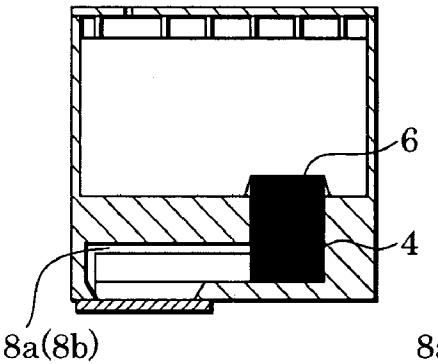

Referring to FIG. 4C, the ink filtered by the filter 6 is introduced into the inductive channels 8*a* and 8*b* quicker than the duct 4 since the inductive channels 8*a* and 8*b* each have a greater capillary force than the duct 4. Moreover, the ink also fills the vertical portion 4*a* of the duct 4, which has a relatively low flow resistance.

Figure 4D:
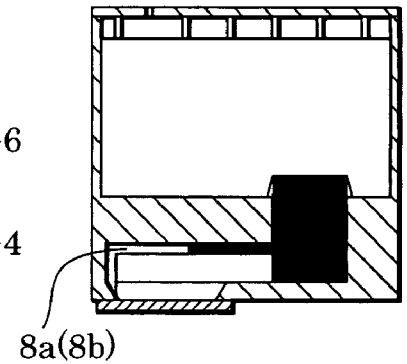
Figure 4E:
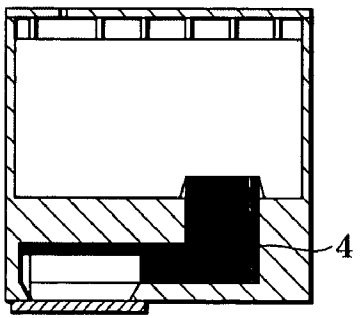

Subsequently, referring to FIG. 4D, the ink in the vertical portion 4*a* of the duct 4 is introduced into the horizontal portions of the inductive channels 8*a* and 8*b*. Referring to FIG. 4E, after filling the horizontal portions of the inductive channels 8*a* and 8*b*, the ink starts to fill the horizontal portion 4*b* of the duct 4, which has a low flow resistance.

Figure 4F:
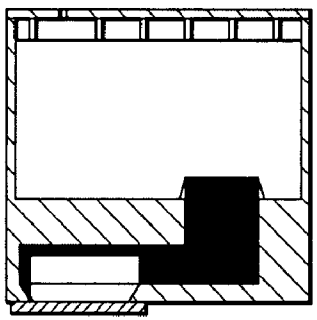
Figure 4G:
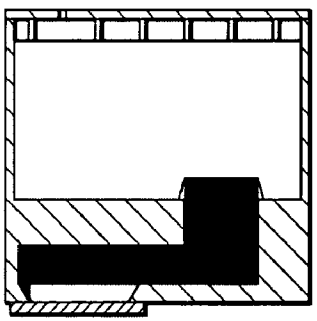
Figure 4H:
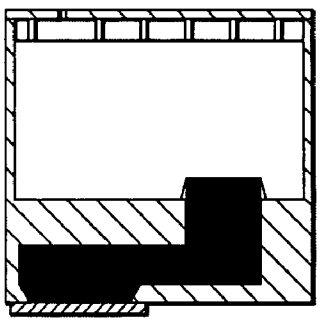

Referring to FIGS. 4F to 4H, after the inductive channels 8*a* and 8*b* are entirely filled with the ink, the ink entirely fills the duct 4.

As described above, the difference in capillary forces between the duct 4 and the inductive channels 8*a* and 8*b* allows the inductive channels 8*a* and 8*b* to be filled with ink prior to the duct 4. This achieves a state where the inductive channels 8*a* and 8*b* are constantly filled with ink in the subsequent use of ink.

Alternatively, such filling of the ink in the duct 4 may be performed by reducing the pressure inside the duct 4 when the ink is inserted to the ink absorber 2 during the fabrication of the inkjet print head. Specifically, a vacuum is first created in the interior of the inkjet print head, and the ink is then inserted to the ink container 3. Subsequently, the inkjet print head is opened, thus allowing the atmospheric pressure to force the ink to enter the duct 4.

During a recording operation by the inkjet print head having the structure described above, if gas is not present inside the duct 4, the duct 4 can smoothly transfer the ink since the flow resistance of the inductive channels 8*a* and 8*b* is greater than that of the duct 4. In this case, the ink is not substantially transferred by the inductive channels 8*a* and 8*b*.

On the other hand, if gas is present inside the duct 4, the gas causes the flow resistance of the duct 4 to be greater than that of the inductive channels 8*a* and 8*b*. In this case, the transferring of ink is mainly performed by the inductive channels 8*a* and 8*b*.

Furthermore, each of the inductive channels 8*a* and 8*b* can be a rectangular groove which is relatively unaffected by the gas inside the duct 4 even if the gas is expanded due to, for example, a change in the environment.

Figure 5A:
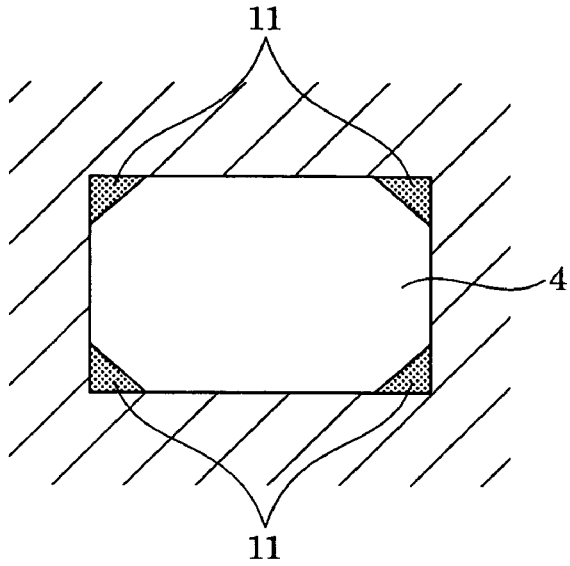
FIGS. 5A to 5C are cross-sectional views illustrating an example of a shape of the duct.
Figure 5B:
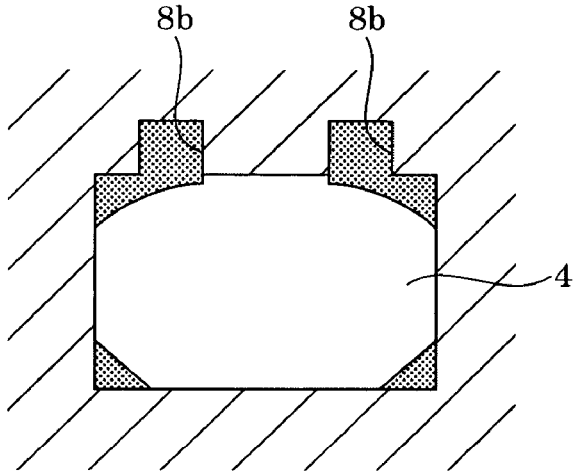
Figure 5C:
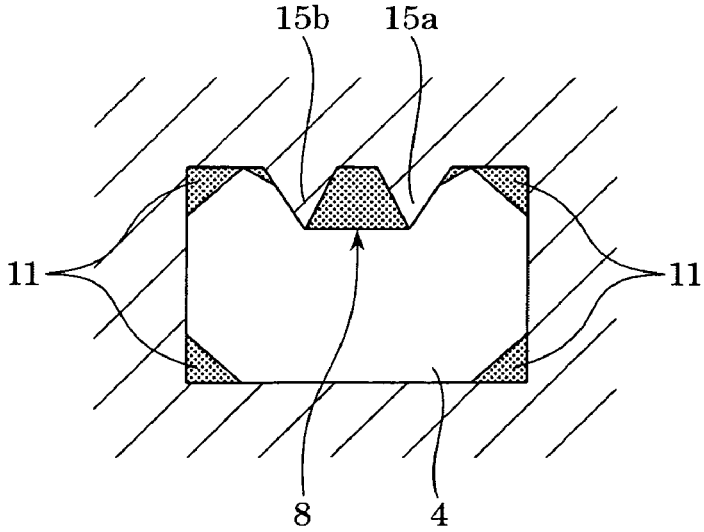

FIGS. 5A to 5C are cross-sectional views illustrating an example of the duct 4 taken along a horizontal plane of the duct 4.

FIG. 5A is a comparative example in which the duct 4 is rectangular in cross-section. The four edges of the duct 4, that is, the four corners in a cross-sectional view, each generate a capillary force so as to retain ink 11.

On the other hand, according to this embodiment, referring to FIG. 5B, the inductive channels 8*a* and 8*b* having a rectangular-groove-like structure are additionally provided in the rectangular duct 4 while communicating with the duct 4. According to such a structure, the ink 11 is retained in the inductive channels 8*a* and 8*b* as well as the four edges of the duct 4. Specifically, the inductive channels 8*a* and 8*b* and two of the edges of the duct 4 adjacent respectively to the inductive channels 8*a* and 8*b* retain the ink 11, such that the ink 11 extends between each of the inductive channels 8*a* and 8*b* and the corresponding one of the two edges.

Although each of the inductive channels 8*a* and 8*b* is a rectangular groove in this embodiment, the duct 4 may alternatively be provided with a plurality of protrusions protruding towards the inner portion of the duct 4. In such a case, a capillary force is generated in a space formed between the protrusions, and such a capillary force may be used to retain the ink 11.

Figure 6B:
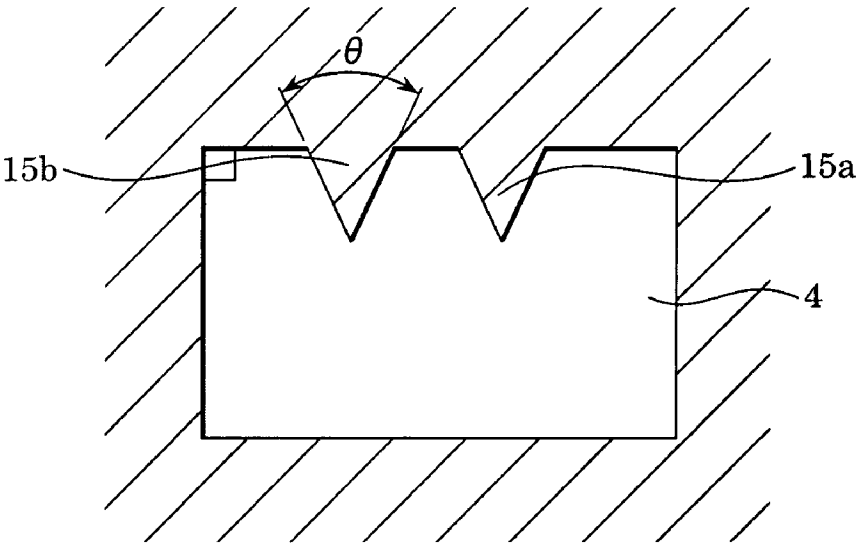
FIGS. 6A and 6B are cross-sectional views illustrating an angle of protrusions between which an inductive channel is formed.
Figure 6A:
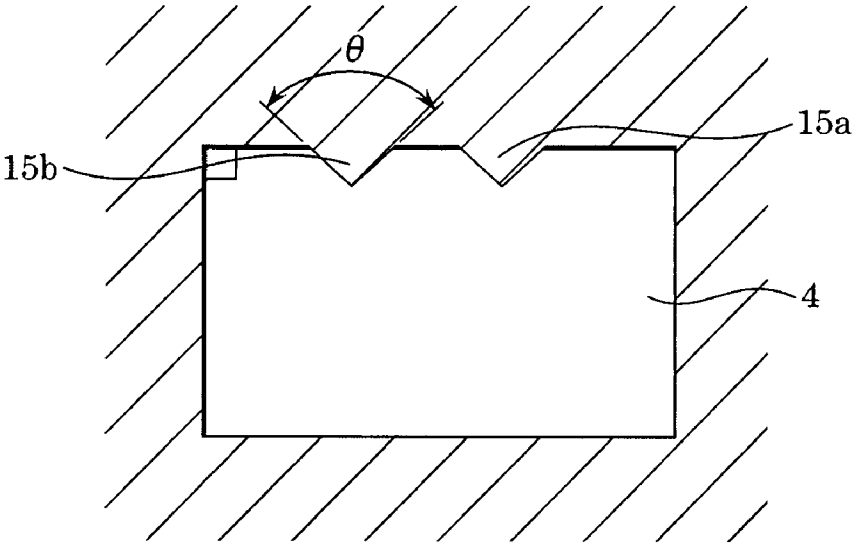

For example, as shown in FIG. 5C, a plurality of protrusions 15*a* and 15*b* each having a triangular shape in cross-section may be provided. In this case, the protrusions 15*a* and 15*b* are separated from each other by a predetermined distance such that an inductive channel 8 is disposed in a space formed between the protrusions 15*a* and 15*b*. Referring to FIGS. 6A and 6B, an angle θ of the triangle formed by each of the protrusions 15*a* and 15*b* may be adjustable. However, to improve the retainability of ink in the inductive channel 8, the triangle formed by each of the protrusions 15*a* and 15*b* may form the angle θ shown in FIG. 6B, which is an acute angle. Furthermore, if the duct 4 is rectangular in cross-section, the capillary force generated by the protrusions 15*a* and 15*b* must be greater than the capillary force generated in the four edges of the duct 4.

Thus, when the ink is retained in the inductive channels 8*a* and 8*b* or the inductive channel 8, the ink 11 can be supplied to the exothermic circuit 1 without any interference since the ink-supplying path extends continuously from the ink container 3 to the ink-supplying hole 7.

Figure 7:
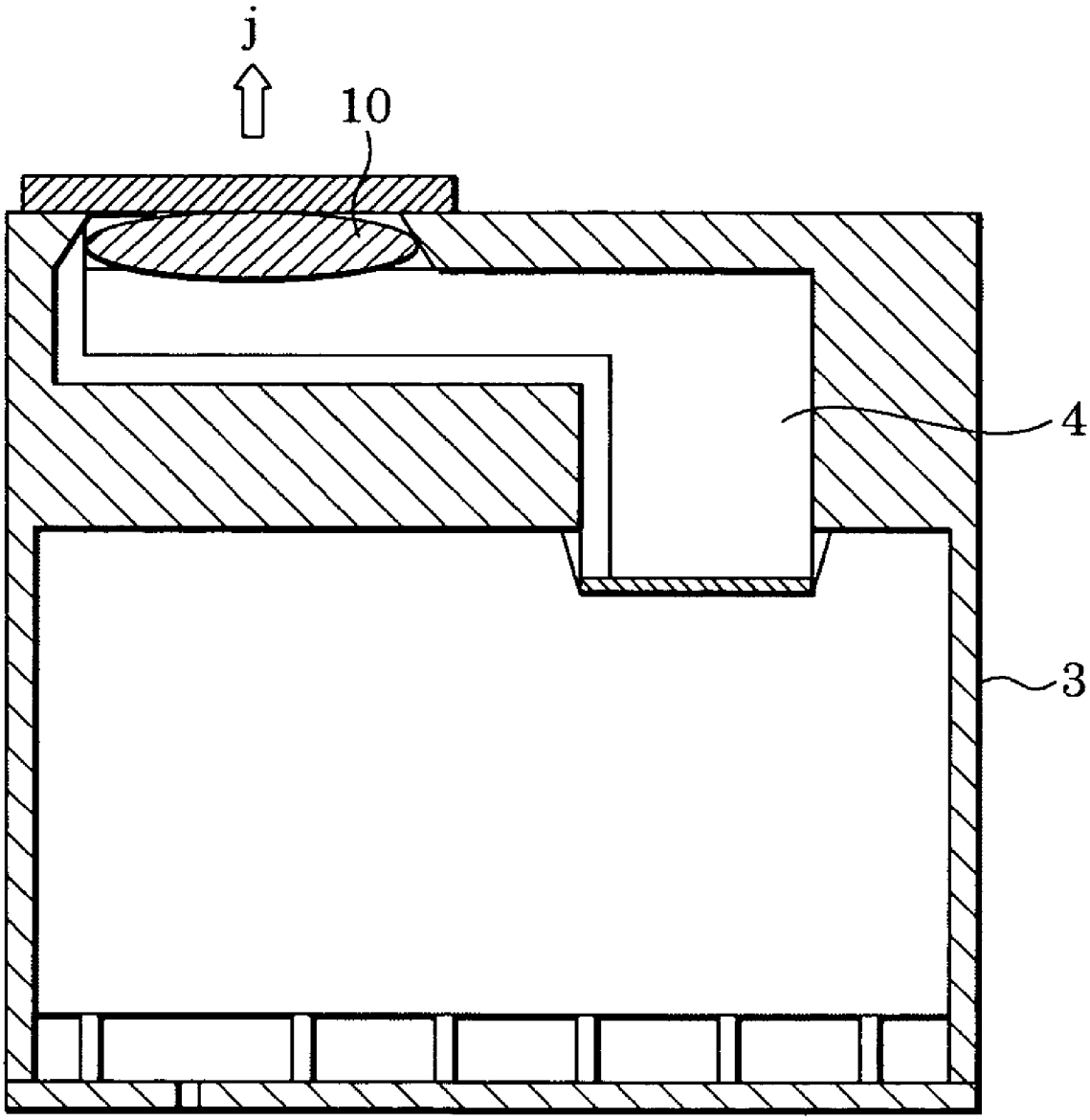
FIG. 7 is a vertical sectional view of the inkjet print head illustrating a state in which the inkjet print head is turned upside down during a vacuuming process of the ink.

Furthermore, for further reducing the gas inside the duct 4, the inkjet print head may be turned upside down when the inkjet print head is vacuumed during the fabrication process, as shown in FIG. 7. Specifically, with the ink discharge nozzles facing upward, the ink is vacuumed in the direction of the arrow j, i.e. the ink-discharging direction. This is effective in that the gas 10 inside the duct 4 can be smoothly vacuumed outward since the gas 10 rises to the ink discharge nozzles due to buoyancy.

Figure 8A:
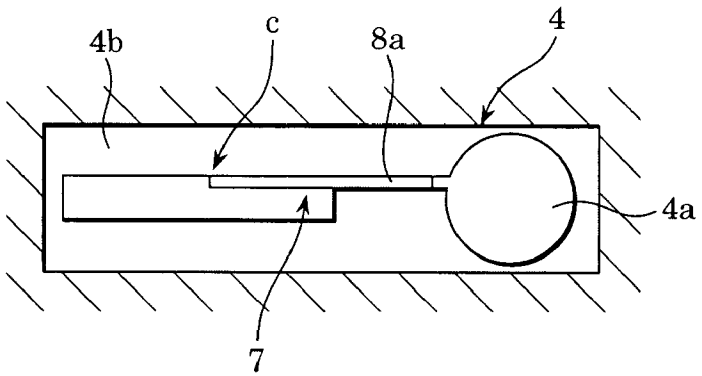
FIGS. 8A to 8D are horizontal cross-sectional views of the inkjet print head taken along line A-A in FIG. 1A, in which each drawing illustrates a connecting position between an ink-supplying hole and one of the inductive channels.
Figure 8B:
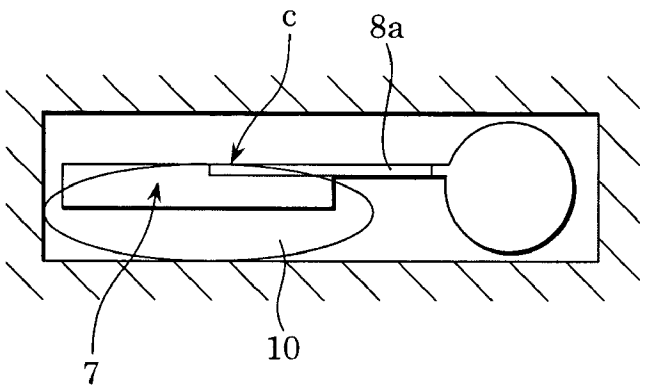

FIGS. 8A to 8D are horizontal cross-sectional views of the inkjet print head taken along line A-A in FIG. 1A. Referring to FIGS. 8A and 8B, in a case where the gas 10 inside the duct 4 expands due to, for example, a change in the environment, the gas 10 inside the duct 4 develops into a substantially spherical shape at a position where the inductive channel 8*a* and the ink-supplying hole 7 connect with each other. For this reason, there are cases where the gas 10 blocks an end c of the inductive channel 8*a* located in the central portion of the ink-supplying hole 7.

Figure 8C:
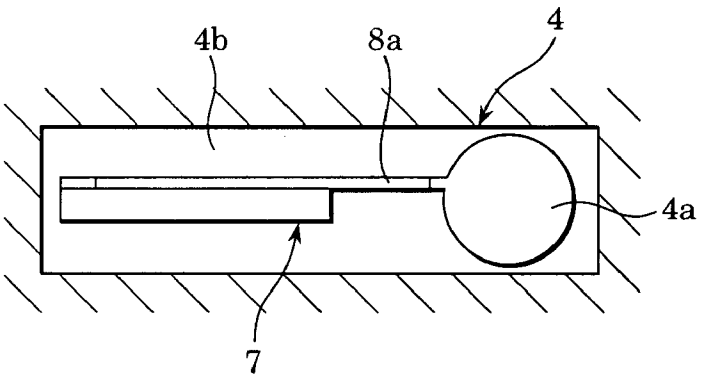
Figure 8D:
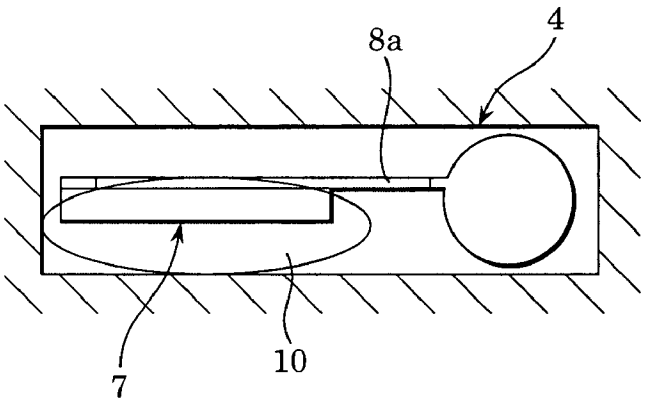

Accordingly, referring to FIGS. 8C and 8D, the inductive channel 8*a* can be connected to one of the corners of the ink-supplying hole 7 so as to reduce the adverse effect of the gas 10 upon the inductive channel 8*a*.

Figure 9A:
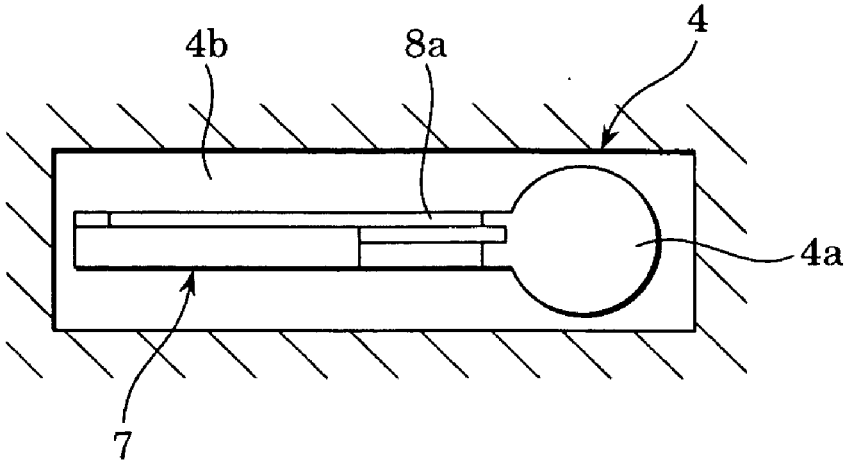
FIGS. 9A and 9B are horizontal cross-sectional views of the inkjet print head taken along line A-A in FIG. 1A, in which each drawing illustrates the connecting positions between the ink-supplying hole and the inductive channels.

Furthermore, referring to FIG. 9A, if the inductive channel 8*a* is connected to only one of the corners of the ink-supplying hole 7, the ink cannot be uniformly distributed to the opposite corner of the ink-supplying hole 7 in the longitudinal direction. To solve this problem, referring to FIG. 9B, the inductive channels 8*a* and 8*b* can be connected to different sections of the ink-supplying hole 7, and moreover, the inductive channels 8*a* and 8*b* can be connected to opposite corners of the ink-supplying hole 7 in the longitudinal direction.

Figure 9B:
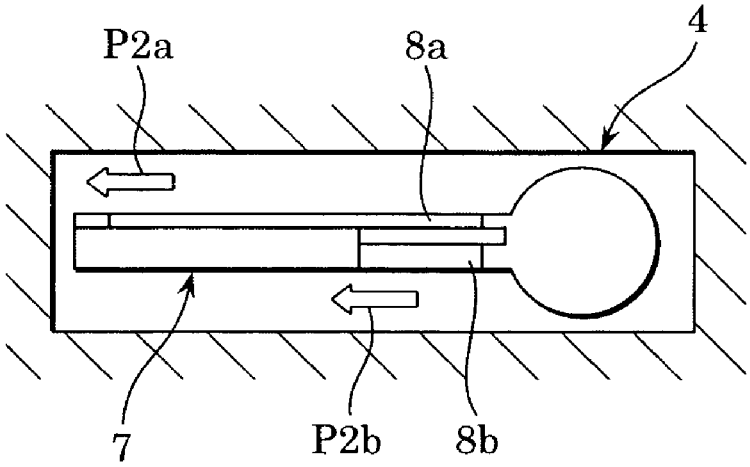

According to this embodiment, the exothermic circuit 1 has four corners. Referring to FIG. 9B, two of the corners on opposite longitudinal ends of the exothermic circuit 1 disposed below the ink-supplying hole 7 are respectively connected to the inductive channels 8*a* and 8*b*, which are independent of each other. Capillary forces P2*a* and P2*b* generated in the respective inductive channels 8*a* and 8*b* are set so as to satisfy the equation P2*a*=P2*b*. This allows the ink to be supplied simultaneously to the two corners on the opposite longitudinal ends of the exothermic circuit 1.

Figure 10A:
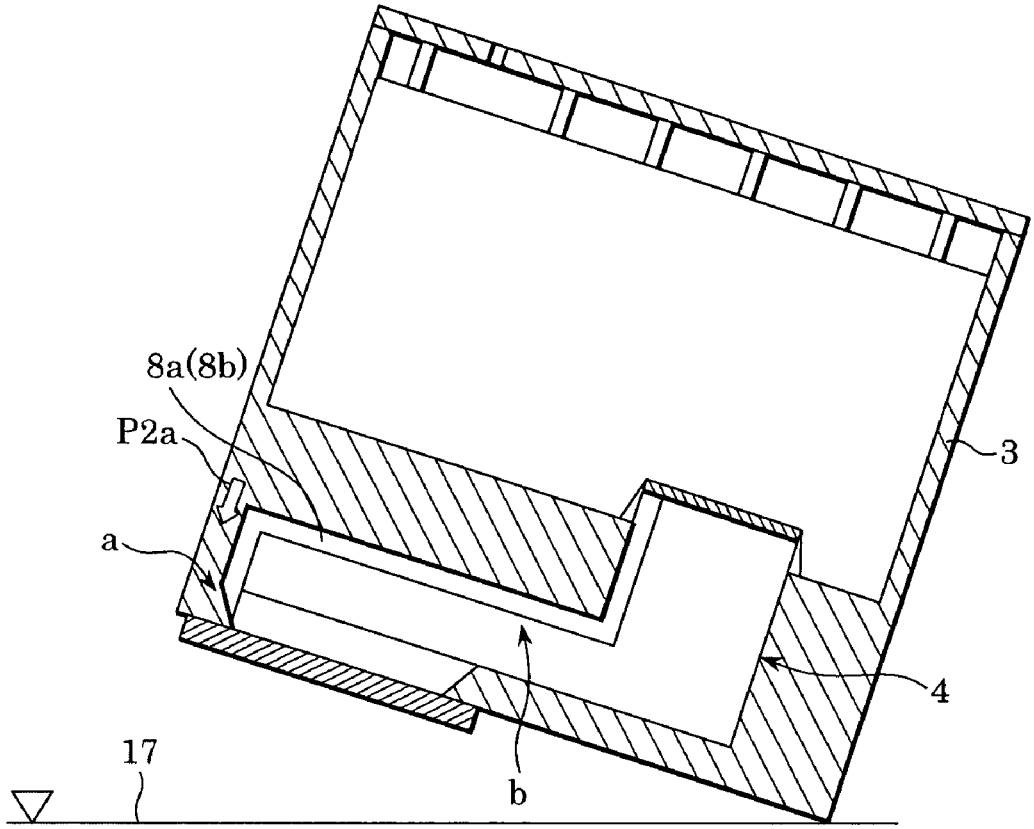
FIG. 10A is a vertical sectional view illustrating a state in which the inkjet print head is tilted with respect to an installation surface of a printer.
Figure 10B:
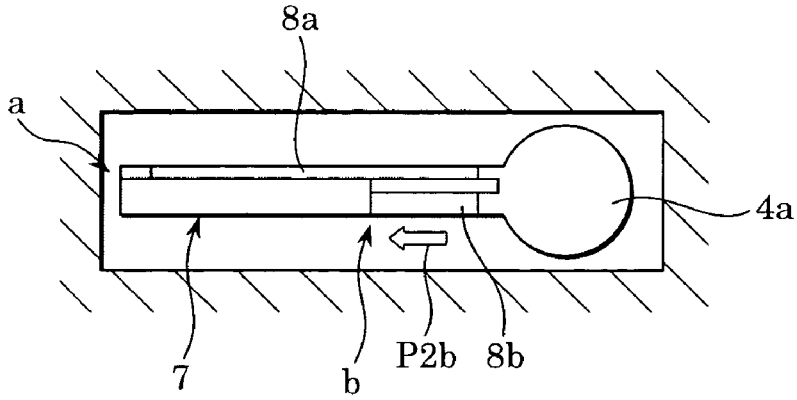
FIG. 10B is a horizontal cross-sectional view illustrating the inductive channels.

FIG. 10A is a vertical sectional view illustrating a state in which the inkjet print head is used in a tilted manner with respect to an installation surface 17 of a printer. FIG. 10B is a horizontal cross-sectional view illustrating the inductive channels 8*a* and 8*b*.

Referring to FIGS. 10A and 10B, when the inkjet print head is tilted with respect to the installation surface 17, the buoyancy of the gas 10 and the weight of the ink cause the ink retained by the capillary force generated in the edges and corners of the duct 4 to empty more easily in the downstream region a of the inductive channel 8*a* than in the downstream region b of the inductive channel 8*b*.

Moreover, due to the positional difference between the inductive channels 8*a* and 8*b*, there are cases where the amount of ink and the timing of ink supplied to the exothermic circuit 1 from the inductive channels 8*a* and 8*b* may be different.

In order to uniformly supply the ink to the exothermic circuit 1 from the inductive channels 8*a* and 8*b*, the capillary forces P2*a* and P2*b* generated in the respective inductive channels 8*a* and 8*b* are set differently so that the ink can be supplied in a stable manner.

To set different capillary forces between the inductive channels 8*a* and 8*b*, the inductive channel 8*a* is tapered such that the width of the inductive channel 8*a* gradually becomes smaller in the downstream region a, as shown in FIG. 10A. This allows the capillary force P2*a* in the downstream region a to be greater. In other words, the cross-sectional area taken along a plane perpendicular to the direction of flow of the ink in the downstream region a of the inductive channel 8*a* adjacent to the exothermic element gradually becomes smaller toward the downstream end of the inductive channel 8*a*.

Alternatively, the inductive channels 8*a* and 8*b* may be provided with different cross-sections each taken along a plane perpendicular to the direction of flow of the ink by providing different sizes between the two, such as different widths of the grooves, different heights, and different lengths. Consequently, this allows different capillary forces between the two channels. Furthermore, in a case where the capillary force is to be generated using the protrusions 15*a* and 15*b*, two pairs of the protrusions 15*a* and 15*b* may alternatively be provided such that each of the inductive channels 8*a* and 8*b* is disposed between the protrusions 15*a* and 15*b* of the corresponding pair. In that case, the angle θ of one pair of the protrusions 15*a* and 15*b* may be set different from that of the other pair of the protrusions 15*a* and 15*b* so as to provide different capillary forces between the inductive channels 8*a* and 8*b*.

As a further alternative, the surfaces of the inductive channels 8*a* and 8*b* may be corrugated so as to give different surface structures between the two channels 8*a* and 8*b*. Consequently, this allows different capillary forces to be generated between the two channels 8*a* and 8*b*.

Furthermore, the duct 4 and the inductive channels 8*a* and 8*b* may be made of different materials, and moreover, may be formed by, for example, multi-color molding so that the materials may create different surface tensions.

Moreover, the surface of at least one of the duct 4 and the inductive channels 8*a* and 8*b* may be additionally processed in order to change, for example, the surface roughness.

Furthermore, the surface of each of the inductive channels 8*a* and 8*b* may be chemically treated for improving, for example, the hydrophilic properties so as to lower the flow resistance.

Moreover, the corners and edges of the duct 4 may be treated to provide water repellency so as to allow easier filling of ink into the inductive channels 8*a* and 8*b*.

Figure 11B:
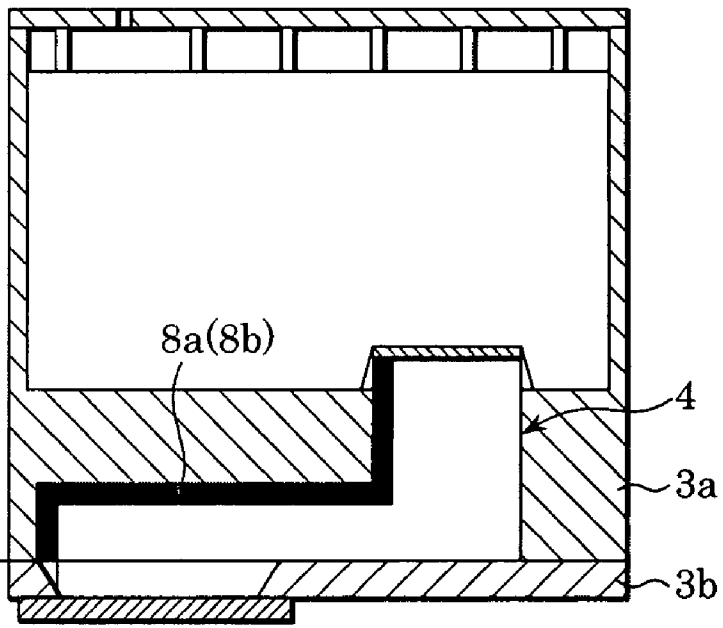
FIGS. 11A and 11B are vertical sectional views illustrating a connecting line between a set of duct-forming components.
Figure 11A:
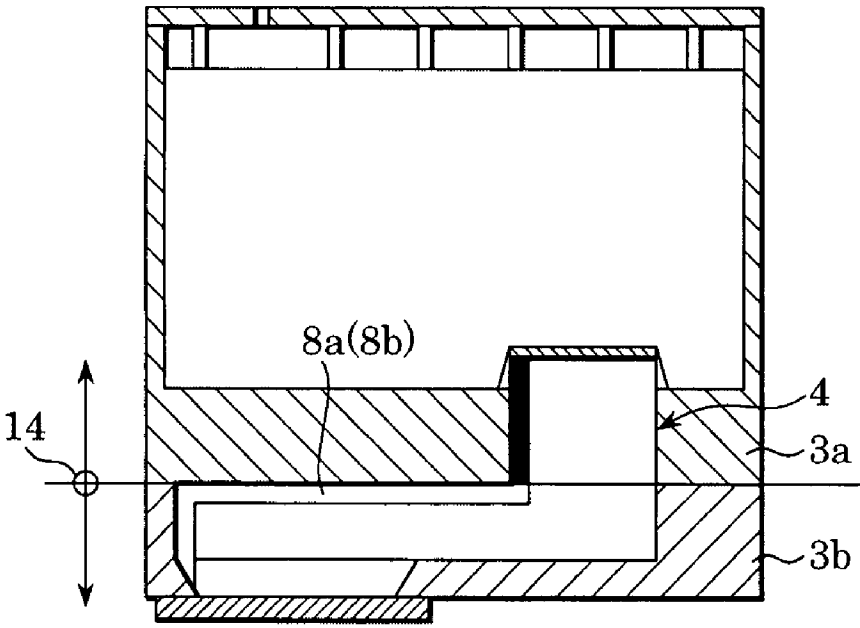

FIGS. 11A and 11B are schematic vertical sectional views illustrating the structure of the inkjet print head. Referring to FIGS. 11A and 11B, the duct 4 of the inkjet print head may be formed by combining together a set of duct-forming components 3*a* and 3*b*.

According to such a structure, if the capillary force generated in the connecting section between the duct-forming components 3*a* and 3*b* is greater than the capillary forces of the inductive channels 8*a* and 8*b* in the duct 4, the continuity of the ink-supplying path may be lost.

In other words, referring to FIG. 11A, if a connection line 14 is positioned higher than the ink-supplying hole 7, there may be cases where the ink in the inductive channels 8*a* and 8*b* will not pass below the connection line 14.

Consequently, as shown in FIG. 11B, the duct-forming components 3*a* and 3*b* of the inkjet print head can have a structure such that the connection line 14 is aligned with the boundary line between the ink-supplying hole 7 and the duct 4. This ensures the continuity of the ink-supplying path to the ink-supplying hole 7.

While the present invention has been described with reference to the exemplary embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

This application claims priority from Japanese Patent Application No. 2003-434952 filed Dec. 26, 2003, which is hereby incorporated by reference herein.

What is claimed is:

1. A liquid discharge head comprising:

a liquid container adapted to hold liquid;

a recording element;

a duct disposed between the liquid container and the recording element and facilitating transferring of the liquid from the liquid container to the recording element;

an inductive channel communicating with the duct, wherein the inductive channel transfers the liquid from the liquid container to the recording element, wherein the inductive channel is configured to generate a capillary force greater than a capillary force of the duct; and protrusions protruding from an inner surface of the duct, wherein the inductive channel is disposed between the protrusions, and wherein the recording element is configured to discharge the liquid transferred from the liquid container.

2. The liquid discharge head according to claim 1, wherein the inductive channel is disposed along the duct, and wherein the inductive channel and the duct change direction at a midsection of the inductive channel and the duct.

3. The liquid discharge head according to claim 2, wherein the inductive channel includes a horizontal portion and a vertical portion, wherein the duct extends continuously from the liquid container to the recording element.

4. The liquid discharge head according to claim 1, wherein each of the protrusions has a substantially triangular cross-section forming an acute angle.

5. The liquid discharge head according to claim 1, wherein an amount of liquid supplied to the recording element per unit time by the inductive channel is greater than an amount of liquid discharged per unit time by the recording element.

6. A liquid discharge head comprising:

a liquid container adapted to hold liquid;

a recording element;

a duct disposed between the liquid container and the recording element and facilitating transferring of the liquid from the liquid container to the recording element; and an inductive channel communicating with the duct, wherein the inductive channel transfers the liquid from the liquid container to the recording element, wherein the inductive channel is configured to generate a capillary force greater than a capillary force of the duct, wherein the recording element is configured to discharge the liquid transferred from the liquid container, wherein the inductive channel has a downstream portion adjacent to the recording element, and wherein a cross-sectional area of the downstream portion taken along a plane perpendicular to a flow direction of the liquid gradually becomes smaller towards a downstream end of the inductive channel.

7. The liquid discharge head according to claim 6, wherein the inductive channel is disposed along the duct, and wherein the inductive channel and the duct change direction at a midsection of the inductive channel and the duct.

8. The liquid discharge head according to claim 6, wherein the inductive channel includes a horizontal portion and a vertical portion, wherein the duct extends continuously from the liquid container to the recording element.

9. The liquid discharge head according to claim 6, wherein an amount of liquid supplied to the recording element per unit time by the inductive channel is greater than an amount of liquid discharged per unit time by the recording element.

10. A liquid discharge head comprising:

a liquid container adapted to hold liquid;

a recording element;

a duct disposed between the liquid container and the recording element and facilitating transferring of the liquid from the liquid container to the recording element; and an inductive channel communicating with the duct, wherein the inductive channel transfers the liquid from the liquid container to the recording element, wherein the inductive channel is configured to generate a capillary force greater than a capillary force of the duct, wherein the inductive channel includes a plurality of inductive channels configured to control a timing to transfer the liquid to the recording element and a liquid amount to be transferred to the recording element, and wherein the recording element is configured to discharge the liquid transferred from the liquid container.

11. The liquid discharge head according to claim 10, wherein the plurality of inductive channels have different physical structures based on the timing and the liquid amount to be controlled.

12. The liquid discharge head according to claim 11, wherein the plurality of inductive channels have different cross-sections taken along a plane perpendicular to the flow direction of the liquid so as to provide the different physical structures between the inductive channels.

13. The liquid discharge head according to claim 10, wherein the inductive channel is disposed along the duct, and wherein the inductive channel and the duct change direction at a midsection of the inductive channel and the duct.

14. The liquid discharge head according to claim 10, wherein the inductive channel includes a horizontal portion and a vertical portion, wherein the duct extends continuously from the liquid container to the recording element.

15. The liquid discharge head according to claim 10, wherein an amount of liquid supplied to the recording element per unit time by the inductive channel is greater than an amount of liquid discharged per unit time by the recording element.

* * * * *